US008998196B2

(12) United States Patent
Tsuda

(10) Patent No.: US 8,998,196 B2
(45) Date of Patent: Apr. 7, 2015

(54) IMAGE FORMING APPARATUS

(71) Applicant: Masaaki Tsuda, Kanagawa (JP)

(72) Inventor: Masaaki Tsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/307,967

(22) Filed: Jun. 18, 2014

(65) Prior Publication Data

US 2015/0008636 A1 Jan. 8, 2015

(30) Foreign Application Priority Data

Jul. 5, 2013 (JP) ..... 2013-141796

(51) Int. Cl.
*B65H 29/70* (2006.01)
*B65H 5/06* (2006.01)
*B65H 5/36* (2006.01)

(52) U.S. Cl.
CPC ..... *B65H 5/068* (2013.01); *B65H 5/062* (2013.01); *B65H 5/36* (2013.01)

(58) Field of Classification Search
CPC ..... B65H 23/34; B65H 2301/5121; B65H 2301/51256; B65H 2301/5122; B65H 29/70; B65H 2404/1371; G03G 15/6576; G03G 2215/00662; G03G 2215/00704
USPC ..... 271/188; 399/406
See application file for complete search history.

(56) References Cited

U.S. PATENT DOCUMENTS

| | | | | |
|---|---|---|---|---|
| 6,415,130 | B1 * | 7/2002 | Fujiwara et al. | 399/401 |
| 7,641,193 | B2 * | 1/2010 | Barinaga et al. | 271/277 |
| 2007/0278735 | A1 | 12/2007 | Sudo et al. | |
| 2010/0245460 | A1 | 9/2010 | Imoto et al. | |

FOREIGN PATENT DOCUMENTS

| | | |
|---|---|---|
| JP | 9-118449 | 5/1997 |
| JP | 2001-058750 | 3/2001 |
| JP | 2003-176071 | 6/2003 |
| JP | 2003-251800 | 9/2003 |
| JP | 2006-188341 | 7/2006 |
| JP | 2008-013366 | 1/2008 |
| JP | 2011-032009 | 2/2011 |
| JP | 2011-184163 | 9/2011 |

* cited by examiner

*Primary Examiner* — Michael McCullough
(74) *Attorney, Agent, or Firm* — Cooper & Dunham LLP

(57) ABSTRACT

An image forming apparatus includes a first roller to come into contact with a first side of a recording medium and a second roller and a third roller to come into contact with a second side of the recording medium opposite the first side. Each of the first roller, the second roller, and the third roller includes a plurality of increased diameter portions and a plurality of decreased diameter portions alternately arranged in an axial direction of each of the first roller, the second roller, and the third roller to produce an uneven outer circumferential surface thereof. The increased diameter portions of the first roller overlap the increased diameter portions of each of the second roller and the third roller, respectively, with a clearance therebetween.

9 Claims, 16 Drawing Sheets

FIG. 6
| t (mm) | 0 | 1 | 3 |
|---|---|---|---|
| RETRANSFER OF INK | YES | NO | YES |
FIG. 7A
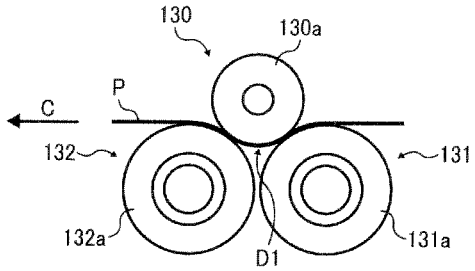
FIG. 7B
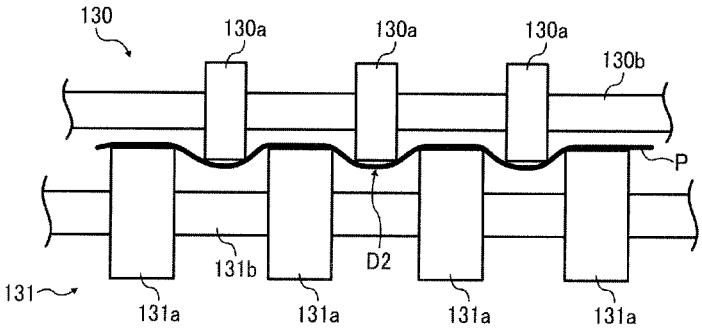

FIG. 14A

| t (mm) | 0.5 | 1 | 3 | 5 | 8 |
|---|---|---|---|---|---|
| RETRANSFER OF INK | YES | YES | NO | NO | NO |

FIG. 14B

| t (mm) | 0.5 | 1 | 3 | 5 | 8 |
|---|---|---|---|---|---|
| RETRANSFER OF INK | — | — | NO | NO | NO |

IMAGE FORMING APPARATUS

CROSS-REFERENCE TO RELATED APPLICATION

This patent application is based on and claims priority pursuant to 35 U.S.C. §119(a) to Japanese Patent Application No. 2013-141796, filed on Jul. 5, 2013, in the Japan Patent Office, the entire disclosure of which is hereby incorporated by reference herein.

BACKGROUND

1. Technical Field

This disclosure relates to an image forming apparatus, and more specifically to an image forming apparatus for forming an image on a recording medium.

2. Description of the Related Art

Related-art image forming apparatuses, such as copiers, facsimile machines, printers, or multifunction printers having two or more of copying, printing, scanning, facsimile, plotter, and other functions, typically form an image on a sheet serving as a recording medium according to image data by an inkjet method using ink and an electrophotographic method using toner. As the sheet is conveyed through the image forming apparatus, the sheet may curl due to a force exerted by a plurality of conveyance rollers that nips and conveys the sheet or uneven distribution of moisture contained in the sheet. For example, when the sheet is conveyed through the image forming apparatus employing the inkjet method, as an imaged side of the sheet absorbs ink, the imaged side of the sheet expands and an edge of the sheet curls toward a non-imaged side of the sheet. If the image forming apparatus includes a recording head unit incorporating a plurality of recording heads aligned in line, the recording heads eject ink onto the sheet at high speed, increasing an amount of moisture absorbed into the sheet per unit time and therefore enlarging curl of the sheet sharply. Additionally, as an amount of ink adhered to the sheet increases, an amount of curl of the sheet increases. Accordingly, the curled sheet may not be conveyed properly. For example, as the edge of the sheet is lifted, the sheet is bent upward. The bent sheet may be jammed or suffer from faulty finishing while conveyed improperly through a finisher.

In order to suppress curl of the sheet, a roller may press against the sheet while the sheet is conveyed between the conveyance rollers to bend and eliminate curl of the sheet. For example, the sheet is nipped and conveyed between a pair of rollers to eliminate curl of the sheet. However, since the pair of rollers presses against the sheet with increased pressure, ink of the image on the sheet is transferred onto one of the pair of rollers that comes into contact with the imaged side of the sheet. Thereafter, ink is retransferred from the one of the pair of rollers onto the sheet, staining the sheet. Alternatively, ink is retransferred from the one of the pair of rollers onto another one of the pair of rollers, which in turn stains the non-imaged side of the next sheet. To address this problem, a cleaner may press against and clean a roller that conveys the sheet as disclosed by JP-2011-032009-A.

However, the cleaner pressing against the roller to prevent retransfer of ink may upsize and complicate the image forming apparatus at increased manufacturing costs.

SUMMARY

In at least one exemplary embodiment of this disclosure, there is provided an image forming apparatus including a first roller to come into contact with a first side of a recording medium that bears an image to convey the recording medium, a second roller disposed opposite the first roller, and a third roller disposed opposite the first roller and aligned with the second roller in a recording medium conveyance direction. The second roller and the third roller come into contact with a second side of the recording medium opposite the first side thereof to convey the recording medium. Each of the first roller, the second roller, and the third roller includes a plurality of increased diameter portions, each of which has an increased diameter, and a plurality of decreased diameter portions, each of which has a decreased diameter. Each of the plurality of increased diameter portions and each of the plurality of decreased diameter portions are alternately arranged in an axial direction of each of the first roller, the second roller, and the third roller to produce an uneven outer circumferential surface thereof. The plurality of increased diameter portions of the second roller is isolated from the plurality of increased diameter portions of the third roller. The plurality of increased diameter portions of the first roller is disposed opposite the plurality of decreased diameter portions of each of the second roller and the third roller, respectively, with a clearance therebetween and the plurality of decreased diameter portions of the first roller is disposed opposite the plurality of increased diameter portions of each of the second roller and the third roller, respectively, with a clearance therebetween such that the plurality of increased diameter portions of the first roller overlaps the plurality of increased diameter portions of each of the second roller and the third roller, respectively, in the recording medium conveyance direction and a direction perpendicular to the recording medium conveyance direction.

In at least one exemplary embodiment of this disclosure, there is provided an image forming apparatus including a first roller to come into contact with a first side of a recording medium that bears an image to convey the recording medium. The first roller includes a plurality of spurs. The image forming apparatus further includes a second roller, disposed opposite the first roller, to come into contact with a second side of the recording medium opposite the first side thereof. The second roller includes a plurality of increased diameter portions, each of which has an increased diameter and a plurality of decreased diameter portions, each of which has a decreased diameter. Each of the plurality of increased diameter portions and each of the plurality of decreased diameter portions of the second roller are alternately arranged in an axial direction of the second roller to produce an uneven outer circumferential surface thereof. The plurality of spurs of the first roller is disposed opposite the plurality of decreased diameter portions of the second roller, respectively, with a clearance therebetween.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 6 is a lookup table showing a relation between retransfer of ink and an interval t between an increased diameter portion of the first roller and the adjacent increased diameter portion of the second roller and between the increased diameter portion of the first roller and the adjacent increased diameter portion of the third roller with the curl correction device shown in FIG. 2;

FIG. 7A is an enlarged sectional view of the first roller, the second roller, and the third roller illustrating a sheet conveyed thereover when the interval t is greater than about 0 mm and smaller than about 3 mm;

FIG. 7B is an enlarged plan view of the first roller and the second roller illustrating the sheet conveyed thereover when the interval t is greater than about 3 mm;

FIG. 14A is a lookup table showing a relation between the interval t and retransfer of ink with the first roller incorporated in the sheet conveyor shown in FIG. 12;

FIG. 14B is a lookup table showing a relation between the interval t and a conveyance force of the first roller and the second roller incorporated in the sheet conveyor shown in FIG. 13 to convey a sheet when a spur does not cause retransfer of ink;

DETAILED DESCRIPTION

Figure 1:
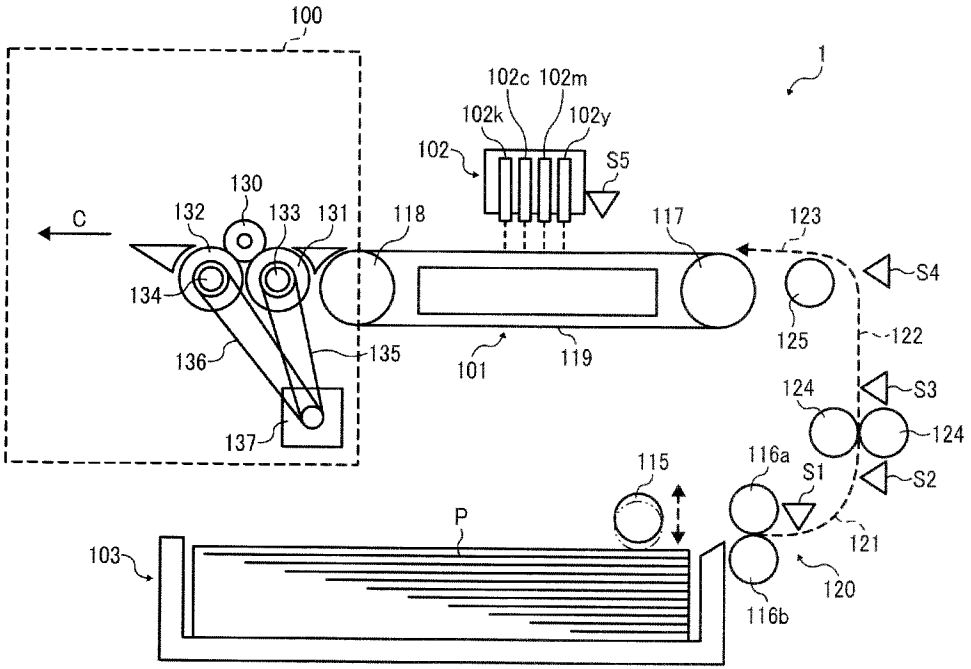
FIG. 1 is a schematic vertical sectional view of an image forming apparatus incorporating a curl correction device according to a first exemplary embodiment of this disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the disclosure and all of the components or elements described in the exemplary embodiments of this disclosure are not necessarily indispensable to the present disclosure.

Referring now to the drawings, wherein like reference numerals designate identical or corresponding parts throughout the several views, exemplary embodiments of the present disclosure are described below.

First, an image forming apparatus 1 according to a first exemplary embodiment of this disclosure is described with reference to FIG. 1.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome images on recording media by an inkjet method.

FIG. 1 illustrates the image forming apparatus 1 incorporating a curl correction device. Although a plurality of exemplary embodiments of the curl correction device is described below, a construction of the image forming apparatus 1 is identical. Accordingly, identical reference numerals are assigned to identical components incorporated in the image forming apparatus 1 and description of the identical components is omitted.

With reference to FIG. 1, a description is provided of a construction of the image forming apparatus 1.

The image forming apparatus 1 includes a sheet tray unit 103 that loads a plurality of sheets P serving as recording media; a sheet feeder 120 that conveys a sheet P picked up from the sheet tray unit 103; a conveyance belt unit 101 that conveys the sheet P conveyed from the sheet feeder 120; a recording head unit 102 serving as an image forming device or an image recording device that ejects ink droplets onto the sheet P conveyed by the conveyance belt unit 101, thus forming an image on the sheet P; and a curl correction device 100 that reduces or eliminates curl of the sheet P.

A pickup roller 115 pivotable between an isolation position indicated by the solid line where the pickup roller 115 is isolated from the sheet P and therefore does not feed the sheet P and a contact position indicated by the dotted line where the pickup roller 115 comes into contact with the sheet P and therefore picks up and feeds the sheet P. As the image forming apparatus 1 receives a print job, the pickup roller 115 feeds an uppermost sheet P of the plurality of sheets P loaded on the sheet tray unit 103 toward the sheet feeder 120 situated downstream from the pickup roller 115 in a sheet conveyance direction C. The sheet feeder 120, constructed of a feed roller 116*a* and a separation roller 116*b*, separates the uppermost sheet P from other sheets P. The separated sheet P is conveyed to an intermediate conveyance roller pair 124 through a conveyance path 121. The intermediate conveyance roller pair 124 conveys the sheet P to the conveyance belt unit 101 through conveyance paths 122 and 123. The conveyance belt unit 101 is constructed of a conveyance roller 117, a tension roller 118, an endless conveyance belt 119 looped over the conveyance roller 117 and the tension roller 118 and driven by a predetermined time, and a holder.

The recording head unit 102 includes line layout liquid ejection heads having a nozzle train constructed of a plurality of nozzles for ejecting liquid droplets that is aligned in a width direction of the sheet P perpendicular to the sheet conveyance direction C. The nozzle train spans at least a width of the sheet P in the width direction thereof. The liquid ejection heads include recording heads 102*y*, 102*m*, 102*c*, and 102*k* that eject yellow, magenta, cyan, and black ink droplets, respectively. Alternatively, the recording heads 102*y*, 102*m*, 102*c*, and 102*k* may be mounted on a carriage installed in a real type image forming apparatus.

As the sheet P reaches the conveyance belt unit 101, the holder of the conveyance belt unit 101 adheres the sheet P to the conveyance belt 119 so that the sheet P moves toward the curl correction device 100 while carried on the conveyance belt 119. As the sheet P moves under the recording head unit 102 disposed above the conveyance belt 119, the recording head unit 102 ejects ink droplets corresponding to an image to be formed on the sheet P. As the ink droplets adhere to the sheet P, the image is formed on the sheet P. The holder of the conveyance belt unit 101 may adhere the sheet P to the conveyance belt 119 by electrostatic attraction, suction, or the like. The conveyance path 121 is provided with sheet sensors S1 and S2 serving as detectors that detect the sheet P. Similarly, the conveyance path 122 is provided with sheet sensors S3 and S4 serving as detectors that detect the sheet P. The conveyance path 123 is provided with a conveyance roller 125 that conveys the sheet P toward the conveyance belt unit 101. A sheet sensor S5 is situated upstream from the recording head unit 102 in the sheet conveyance direction C to detect the sheet P.

Figure 2:
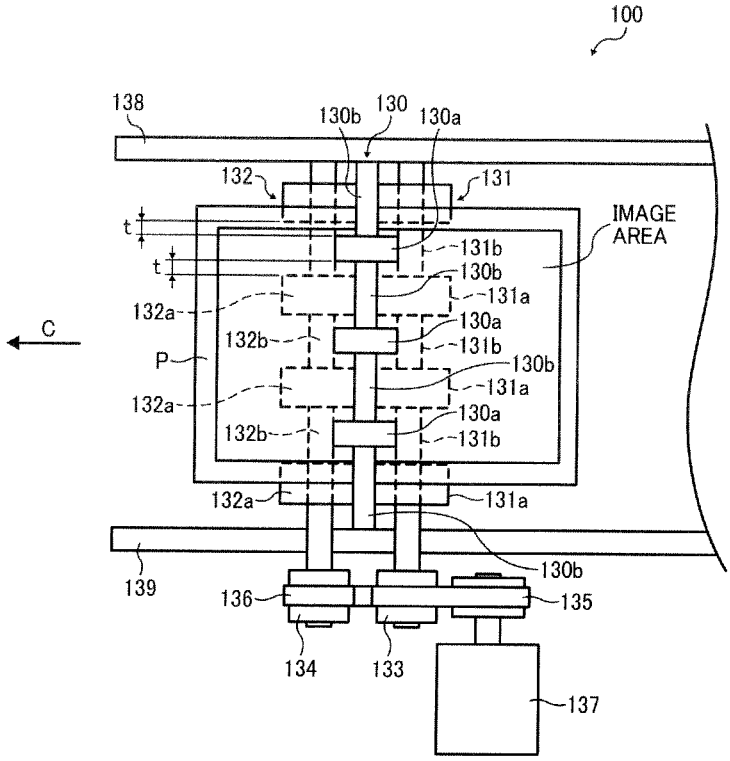
FIG. 2 is a plan view of the curl correction device shown in FIG. 1.

With reference to FIGS. 1 and 2, a detailed description is now given of a construction of the curl correction device 100 according to the first exemplary embodiment, that is situated downstream from the recording head unit 102 in the sheet conveyance direction C.

As shown in FIG. 1, the curl correction device 100 (e.g., a sheet straightening device) includes a plurality of rollers that reduces or eliminates curl of the sheet P as it conveys the sheet P. The plurality of rollers of the curl correction device 100 includes a first roller 130 that contacts an imaged side, that is, a first side, of the sheet P that bears the image formed by the recording head unit 102, a second roller 131 that contacts a non-imaged side, that is, a second side, of the sheet P that is opposite the imaged side of the sheet P, and a third roller 132 situated downstream from the second roller 131 in the sheet conveyance direction C. The second roller 131 and the third roller 132 are driven and rotated by a driving force transmitted from a common driving motor 137 serving as a driver through belts 135 and 136 and pulleys 133 and 134. Thus, the second roller 131 and the third roller 132 serve as driving rollers that convey the sheet P. Contrarily, the first roller 130 serves as a driven roller that is driven and rotated by the sheet P conveyed by the second roller 131 and the third roller 132.

FIG. 2 is a plan view of the curl correction device 100. As shown in FIG. 2, the second roller 131 includes a plurality of increased diameter portions 131*a* and a plurality of decreased diameter portions 131*b* alternately arranged in an axial direction of the second roller 131 to produce an uneven outer circumferential surface. Similarly, the third roller 132 includes a plurality of increased diameter portions 132*a* and a plurality of decreased diameter portions 132*b* alternately arranged in an axial direction of the third roller 132 to produce an uneven outer circumferential surface. The first roller 130 includes a plurality of increased diameter portions 130*a* and a plurality of decreased diameter portions 130*b* alternately arranged in an axial direction of the first roller 130 to produce an uneven outer circumferential surface. The increased diameter portion 130*a* of the first roller 130 is smaller than the increased diameter portion 131*a* of the second roller 131 and the increased diameter portion 132*a* of the third roller 132. The increased diameter portion 131*a* of the second roller 131 is disposed opposite the increased diameter portion 132*a* of the third roller 132. That is, the position of the increased diameter portion 131*a* of the second roller 131 is identical to the position of the increased diameter portion 132*a* of the third roller 132 in the axial direction of the second roller 131 and the third roller 132. The increased diameter portion 130*a* of the first roller 130 is disposed opposite the decreased diameter portion 131*b* of the second roller 131 and the decreased diameter portion 132*b* of the third roller 132. The increased diameter portion 130*a* of the first roller 130 overlaps the increased diameter portion 131*a* of the second roller 131 and the increased diameter portion 132*a* of the third roller 132 when seen in the axial direction of the first roller 130. However, the first roller 130 is isolated from the second roller 131 and the third roller 132. In other words, the increased diameter portion 130*a* of the first roller 130 overlaps the increased diameter portion 131*a* of the second roller 131 and the increased diameter portion 132*a* of the third roller 132 in the sheet conveyance direction C and a direction perpendicular to the sheet conveyance direction C.

For example, a front frame 139 situated at a front of the image forming apparatus 1 and a rear frame 138 situated at a rear of the image forming apparatus 1 support the first roller 130, the second roller 131, and the third roller 132 such that the first roller 130 is isolated from the second roller 131 and the third roller 132. The front frame 139 and the rear frame 138 also support other components of the image forming apparatus 1 depicted in FIG. 1. Specifically, the front frame 139 and the rear frame 138 rotatably mount and support rollers that convey the sheet P, that is, the feed roller 116*a*, the separation roller 116*b*, the intermediate conveyance roller pair 124, the conveyance roller 125, the conveyance roller 117, and the tension roller 118.

A description is provided of an operation of the curl correction device 100 having the construction described above.

As shown in FIG. 1, the sheet P conveyed from the sheet tray unit 103 and bearing the image formed by the recording head unit 102 while the sheet P is adhered to the conveyance belt 119 is conveyed to the curl correction device 100 situated downstream from the recording head unit 102 in the sheet conveyance direction C such that a center of the sheet P is lifted upward toward the recording head unit 102 by moisture contained in the sheet P and edges of the sheet P are curled downward. As the curled sheet P is conveyed through the curl correction device 100 such that the sheet P is sandwiched between the first roller 130 and the upstream second roller 131 at an upstream nip, when a leading edge of the sheet P reaches a downstream nip formed between the first roller 130 and the downstream third roller 132, the first roller 130 contacting the imaged side of the sheet P curls the sheet P upward to offset a downward curl produced before the sheet P enters the curl correction device 100. Thus, the curl correction device 100 reduces curl of the sheet P. Thereafter, the sheet P is discharged from the curl correction device 100 in the sheet conveyance direction C.

Figure 3A:
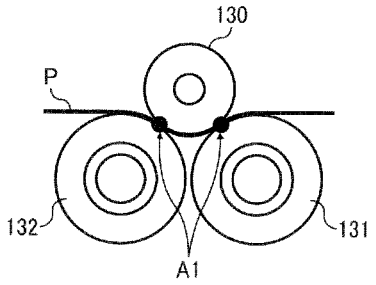
FIG. 3A is an enlarged vertical sectional view of a first roller, a second roller, and a third roller of a comparative curl correction device in a state in which the first roller contacts an increased diameter portion of each of the second roller and the third roller.
Figure 3B:
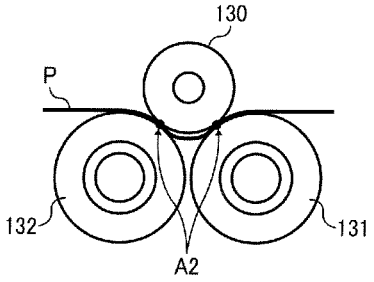
FIG. 3B is an enlarged vertical sectional view of the first roller, the second roller, and the third roller incorporated in the curl correction device shown in FIG. 2 in a state in which the first roller does not contact the increased diameter portion of each of the second roller and the third roller.

Since the first roller 130 comes into contact with the imaged side of the sheet P, if the image on the imaged side of the sheet P is not dried, ink of the image may move from the imaged side of the sheet P to the first roller 130 and may move from the first roller 130 onto the sheet P, staining the sheet P. FIG. 3A is an enlarged vertical sectional view of the first roller 130, the second roller 131, and the third roller 132 in a state in which the first roller 130 contacts the increased diameter portion 131*a* of the second roller 131 and the increased diameter portion 132*a* of the third roller 132. FIG. 3B is an enlarged vertical sectional view of the first roller 130, the second roller 131, and the third roller 132 in a state in which the first roller 130 does not contact the increased diameter portion 131*a* of the second roller 131 and the increased diameter portion 132*a* of the third roller 132.

If the first roller 130 is configured to contact the increased diameter portion 131*a* of the second roller 131 and the increased diameter portion 132*a* of the third roller 132 as shown in FIG. 3A, the first roller 130 contacts the sheet P at points thereon indicated by arrows A1 with increased pressure therebetween, increasing an amount of ink that moves from the sheet P to the first roller 130 and further moves from the first roller 130 to the sheet P. To address this circumstance, according to this exemplary embodiment, the first roller 130 disposed opposite the imaged side of the sheet P does not contact the increased diameter portion 131*a* of the second roller 131 and the increased diameter portion 132*a* of the third roller 132 that are disposed opposite the non-imaged side of the sheet P as shown in FIG. 3B. Accordingly, the first roller 130 contacts the sheet P at surface thereon defined by arrows A2 with decreased pressure therebetween, decreasing an amount of ink that moves from the sheet P to the first roller 130 and further moves from the first roller 130 to the sheet P. Since the first roller 130 does not contact the second roller 131 and the third roller 132, ink does not move from the first roller 130 to the second roller 131 and the third roller 132. Accordingly, the second roller 131 and the third roller 132 are not stained by ink and therefore do not stain the non-imaged side of the sheet P conveyed over the second roller 131 and the third roller 132. The first roller 130, the second roller 131, and the third roller 132 having the uneven outer circumferential surface are manufactured by molding or shaving a single smooth shaft into an uneven shaft or mounting a plurality of rollers having a diameter greater than that of a shaft on the shaft with an interval between the adjacent rollers in an axial direction of the shaft. Thus, the first roller 130, the second roller 131, and the third roller 132 are manufactured at reduced costs while reducing an amount of ink transferred from the sheet P onto the first roller 130 and retransferred from the first roller 130 onto the sheet P. Additionally, the first roller 130 isolated from the second roller 131 and the third roller 132 extends the life of the first roller 130, the second roller 131, and the third roller 132.

Figure 4:
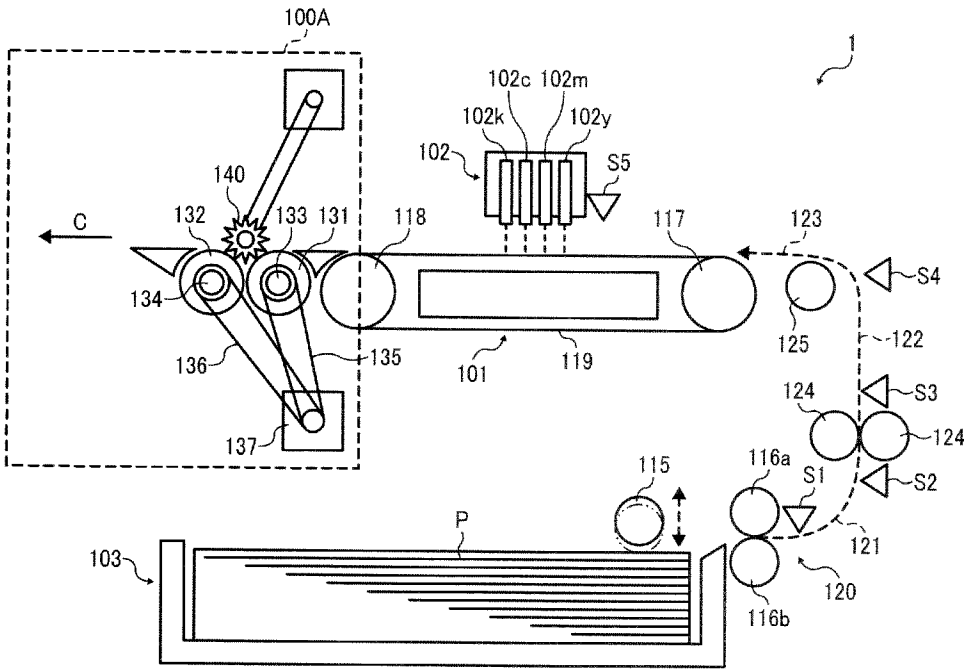
FIG. 4 is a schematic vertical sectional view of the image forming apparatus incorporating a curl correction device according to a second exemplary embodiment of this disclosure.
Figure 5:
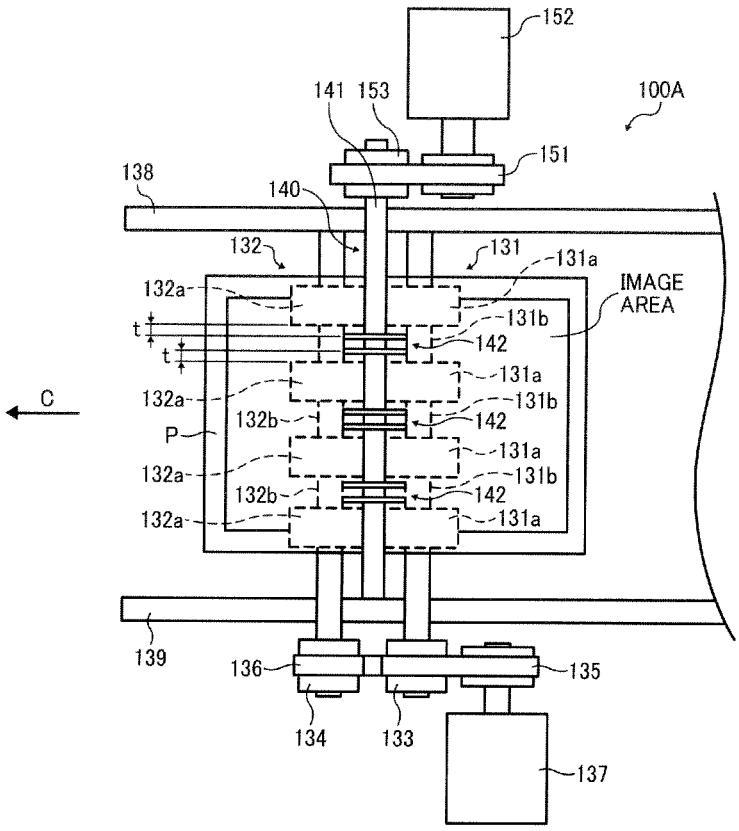
FIG. 5 is a plan view of the curl correction device shown in FIG. 4.

With reference to FIGS. 4 and 5, a description is provided of a construction of a curl correction device 100A according to a second exemplary embodiment.

FIG. 4 is a schematic vertical sectional view of the image forming apparatus 1 incorporating the curl correction device 100A. FIG. 5 is a plan view of the curl correction device 100A. As shown in FIG. 4, the curl correction device 100A includes a first roller 140 that comes into contact with the imaged side of the sheet P, instead of the first roller 130 depicted in FIG. 1. As shown in FIG. 5, the first roller 140 includes a shaft 141 and a plurality of spurs 142 mounted on the shaft 141 with an interval between the adjacent spurs 142 in an axial direction of the first roller 140. The first roller 140 serves as a driving roller that receives a driving force transmitted from a driving motor 152 through a belt 151 and a pulley 153. Other components of the curl correction device 100A are equivalent to those of the curl correction device 100 depicted in FIGS. 1 and 2.

An outermost diameter of each spur 142 serving as an increased diameter portion of the first roller 140 is smaller than an outer diameter of the increased diameter portion 131*a* of the second roller 131 and the increased diameter portion 132*a* of the third roller 132. The spur 142 of the first roller 140 is disposed opposite the decreased diameter portion 131*b* of the second roller 131 and the decreased diameter portion 132*b* of the third roller 132 such that the spur 142 is interposed between the decreased diameter portion 131*b* of the second roller 131 and the decreased diameter portion 132*b* of the third roller 132 in the sheet conveyance direction C. The spurs 142 decrease the area of the first roller 140 where the first roller 140 contacts the imaged side of the sheet P, reducing ink that may be transferred from the sheet P onto the first roller 140 and retransferred from the first roller 140 onto the sheet P. Additionally, the first roller 140 does not come into contact with the second roller 131 and the third roller 132, increasing the life of the first roller 140, the second roller 131, and the third roller 132.

As shown in FIG. 2, an interval t defines an interval between the increased diameter portion 130*a* serving as a projection of the first roller 130 and the adjacent increased diameter portion 131*a* serving as a projection of the second roller 131 in the axial direction thereof and an interval between the increased diameter portion 130*a* of the first roller 130 and the adjacent increased diameter portion 132*a* serving as a projection of the third roller 132 in the axial direction thereof. As the interval t varies, deformation of the sheet P conveyed by the first roller 130, the second roller 131, and the third roller 132 varies. Accordingly, transfer of ink from the imaged side of the sheet P to the first roller 130 and retransfer of ink from the first roller 130 to the sheet P, which stains the sheet P (hereinafter referred to as retransfer of ink) may vary depending on the interval t as shown in FIG. 6. FIG. 6 is a lookup table showing a relation between the interval t and retransfer of ink.

As shown in FIG. 6, when the interval t is 0 mm, that is, when the first roller 130 contacts the increased diameter portion 131*a* of the second roller 131 and the increased diameter portion 132*a* of the third roller 132 unlike the exemplary embodiments described above, retransfer of ink is visually identified. When the interval t is 1 mm, retransfer of ink is not visually identified. When the interval t is 3 mm, retransfer of ink is visually identified.

With reference to FIGS. 7A and 7B, a description is provided of deformation of the sheet P.

FIG. 7A is an enlarged sectional view of the first roller 130, the second roller 131, and the third roller 132 illustrating the sheet P conveyed thereover when the interval t is greater than about 0 mm and smaller than about 3 mm. FIG. 7B is an enlarged plan view of the first roller 130 and the second roller 131 illustrating the sheet P conveyed thereover when the interval t is greater than about 3 mm.

As shown in FIG. 7A, as the first roller 130, the second roller 131, and the third roller 132 rotate to convey the sheet P, when the interval t is greater than about 0 mm and smaller than about 3 mm, a decreased interval between the increased diameter portion 130*a* of the first roller 130 and the adjacent increased diameter portions 131*a* of the second roller 131 and a decreased interval between the increased diameter portion 130*a* of the first roller 130 and the adjacent increased diameter portions 132*a* of the third roller 132 virtually contour the first roller 130, the second roller 131, and the third roller 132 into axially even rollers having outer diameters equivalent to those of the increased diameter portions 130*a*, 131*a*, and 132*a*, respectively. Accordingly, the sheet P nipped between the first roller 130 and each of the second roller 131 and the third roller 132 deforms in the sheet conveyance direction C in correspondence to roundness of the first roller 130 as indicated by an arrow D1 in FIG. 7A. Consequently, the sheet P comes into contact with an outer circumferential surface of the first roller 130, the second roller 131, and the third roller 132 in an increased area thereon with decreased pressure therebetween, reducing an amount of ink that moves from the imaged side of the sheet P to the first roller 130.

Conversely, when the interval t increases and is greater than about 3 mm, the sheet P is deformed or wound by the increased diameter portions 130*a* of the first roller 130 and the increased diameter portions 131*a* of the second roller 131 in the axial direction of the first roller 130 and the second roller 131 as indicated by an arrow D2 in FIG. 7B. Accordingly, the sheet P comes into point contact with the outer circumferential surface of the first roller 130 in a decreased area thereon with increased pressure therebetween, increasing an amount of ink that is transferred from the imaged side of the sheet P to the first roller 130 and therefore increasing retransfer of ink from the first roller 130 to the sheet P.

On the other hand, as the sheet P comes into contact with the first roller 140 incorporating the spurs 142 serving as increased diameter portions shown in FIGS. 4 and 5, when the sheet P strikes an outer edge of the spurs 142, the spurs 142 may cause jitter on the image on the sheet P. To address this circumstance, the driving motor 152 and the belt 151 drive and rotate the first roller 140 to decrease impact caused by the sheet P striking the first roller 140, thus suppressing shock jitter and preventing faulty conveyance of the sheet P such as folding and jamming of the sheet P.

Figure 8:
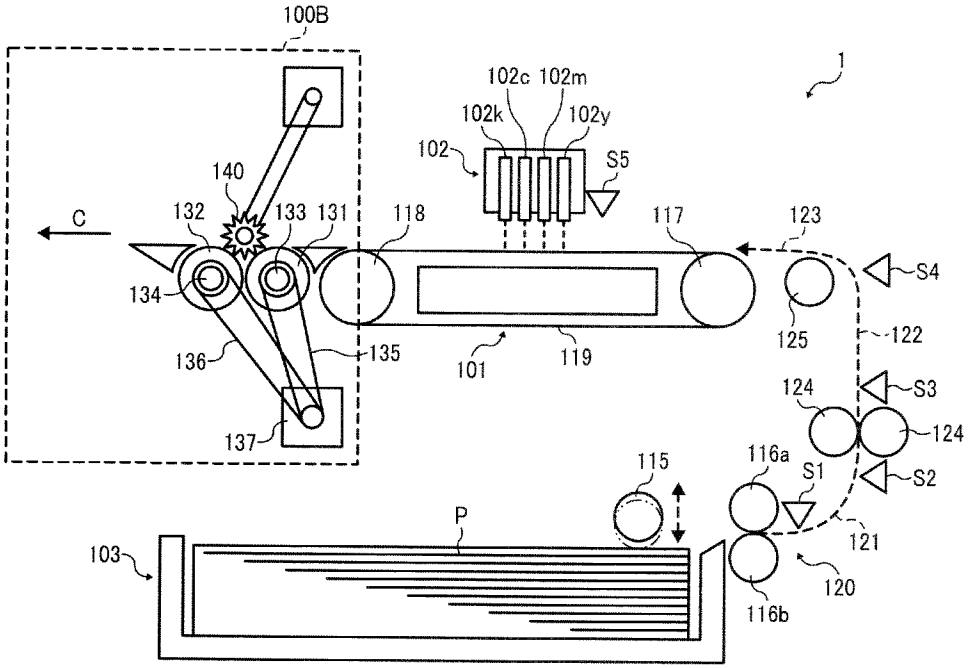
FIG. 8 is a schematic vertical sectional view of the image forming apparatus incorporating a curl correction device according to a third exemplary embodiment of this disclosure.
Figure 9:
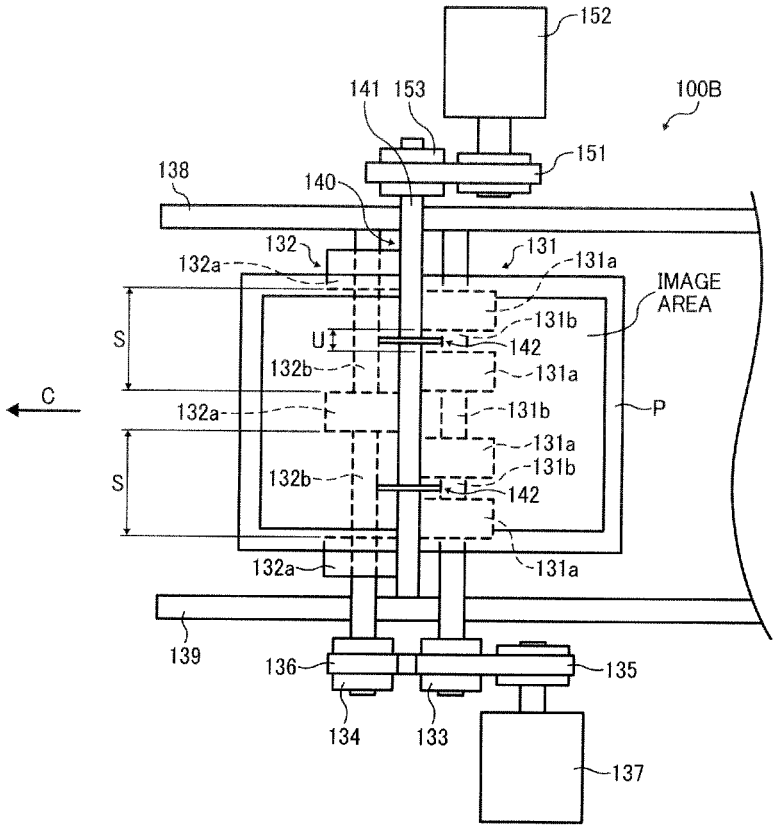
FIG. 9 is a plan view of the curl correction device shown in FIG. 8.

With reference to FIGS. 8 and 9, a description is provided of a construction of a curl correction device 100B according to a third exemplary embodiment.

FIG. 8 is a schematic vertical sectional view of the image forming apparatus 1 incorporating the curl correction device 100B. FIG. 9 is a plan view of the curl correction device 100B.

As shown in FIG. 9, the curl correction device 100B includes the third roller 132 incorporating the increased diameter portions 132*a* aligned in the axial direction of the third roller 132 with an increased interval S between the adjacent increased diameter portions 132*a* in the axial direction of the third roller 132. The increased interval S is greater than an interval between the adjacent increased diameter portions 132*a* of the third roller 132 of the curl correction device 100A depicted in FIG. 5. That is, the increased interval S is greater than an interval U between the adjacent increased diameter portions 131*a* of the second roller 131 in the axial direction thereof. For example, the third roller 132 of the curl correction device 100A depicted in FIG. 5 includes the four increased diameter portions 132*a*. Conversely, the third roller 132 of the curl correction device 100B depicted in FIG. 9 includes the three increased diameter portions 132*a* aligned in the axial direction of the third roller 132 with the increased interval S between the adjacent increased diameter portions 132*a*.

As shown in FIG. 9, the two increased diameter portions 131*a* of the upstream second roller 131 are interposed between the adjacent increased diameter portions 132*a* of the downstream third roller 132 in the axial direction of the second roller 131 and the third roller 132. The spur 142 of the first roller 140 is interposed between the adjacent increased diameter portions 132*a* of the third roller 132 in the axial direction of the first roller 140. The increased interval S between the adjacent increased diameter portions 132*a* of the third roller 132 in the axial direction thereof prevents the sheet P from warping or waving as the sheet P is nipped between the third roller 132 and the first roller 140 before the sheet P is discharged from the curl correction device 100B.

Figure 10:
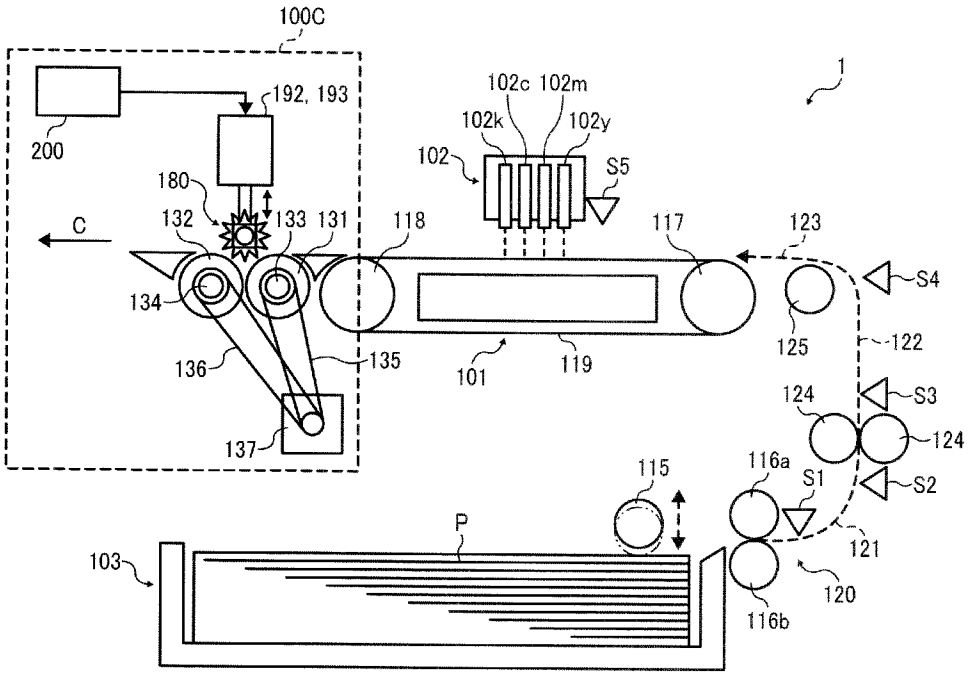
FIG. 10 is a schematic vertical sectional view of the image forming apparatus incorporating a curl correction device according to a fourth exemplary embodiment of this disclosure.
Figure 11:
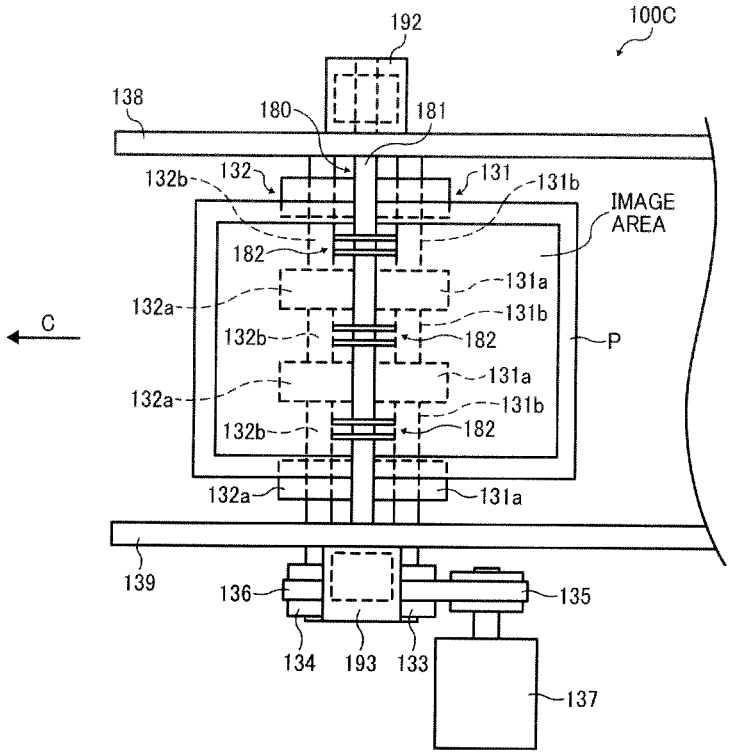
FIG. 11 is a plan view of the curl correction device shown in FIG. 10.

With reference to FIGS. 10 and 11, a description is provided of a construction of a curl correction device 100C according to a fourth exemplary embodiment.

FIG. 10 is a schematic vertical sectional view of the image forming apparatus 1 incorporating the curl correction device 100C. FIG. 11 is a plan view of the curl correction device 100C.

As shown in FIG. 10, the curl correction device 100C includes a first roller 180 that comes into contact with the imaged side of the sheet P. As shown in FIG. 11, the first roller 180 includes a shaft 181 and a plurality of spurs 182 mounted on the shaft 181. As shown in FIG. 10, electromagnetic solenoids 192 and 193 serving as a driver move the first roller 180 in a direction perpendicular to the imaged face of the sheet P. An outermost diameter of each spur 182 serving as an increased diameter portion of the first roller 180 is smaller than an outer diameter of the increased diameter portion 131*a* of the second roller 131 and the increased diameter portion 132*a* of the third roller 132. As shown in FIG. 11, the spur 182 of the first roller 180 is disposed opposite the decreased diameter portion 131*b* of the second roller 131 and the decreased diameter portion 132*b* of the third roller 132 such that the spur 182 is interposed between the decreased diameter portion 131*b* of the second roller 131 and the decreased diameter portion 132*b* of the third roller 132 in the sheet conveyance direction C. The two spurs 182 of the first roller 180 are interposed between the decreased diameter portion 131*b* of the second roller 131 and the decreased diameter portion 132*b* of the third roller 132 in the sheet conveyance direction C.

As shown in FIG. 10, the electromagnetic solenoids 192 and 193 are electrically connected to a controller 200 through electric wiring. For example, the controller 200 (e.g., a processor) may be a micro computer constructed of devices such as a central processing unit (CPU), a read-only memory (ROM), a random access memory (RAM), and an interface circuit. The controller 200 turns on and off the electromagnetic solenoids 192 and 193 according to the ambient temperature, humidity, and paper type (e.g., paper thickness and paper weight). The electromagnetic solenoids 192 and 193 are connected to both lateral ends of the shaft 181 of the first roller 180 in an axial direction thereof to move the spurs 182. Since sheets P having various rigidities are conveyed through the image forming apparatus 1, if the spurs 182 are stationary, when a thick sheet P having an increased rigidity is conveyed over the spurs 182, the spurs 182 may press against the sheet P with increased pressure therebetween, causing an outer edge of the respective spurs 182 to damage, scratch, or scrape the image on the sheet P.

Conversely, when a thin sheet P or a sheet P having a decreased rigidity under high humidity is conveyed over the spurs 182, the stationary spurs 182 may degrade its performance to reduce curl of the sheet P. To address this circumstance, a table defining the position of the movable spurs 182 that varies depending on the paper type and environmental conditions is preset in the controller 200. The controller 200 changes the position of the spurs 182 according to the paper type and environmental conditions, thus reducing curl of the sheet P precisely without faulty conveyance of the sheet P. Accordingly, the curl correction device 100C improves robustness against error factor such as the paper type and environmental conditions.

As shown in FIGS. 1, 4, 8, and 10, the curl correction devices 100, 100A, 100B, and 100C are situated downstream from the recording head unit 102 in the sheet conveyance direction C to convey the sheet P. In this aspect, the curl correction devices 100, 100A, 100B, and 100C also serve as a sheet conveyer that conveys the sheet P.

According to the first to fourth exemplary embodiments described above, the curl correction devices 100, 100A, 100B, and 100C situated downstream from the recording head unit 102 in the sheet conveyance direction C suppress curl of the sheet P after the recording head unit 102 forms the image on the sheet P by ejecting ink droplets onto the sheet P. However, the sheet P may curl not only when the recording head unit 102 forms the image on the sheet P but also when the sheet P is conveyed in the image forming apparatus 1 at positions other than the position of the recording head unit 102. To address this circumstance, the curl correction devices 100, 100A, 100B, and 100C may be located at other positions where the sheet P conveyed in the image forming apparatus 1 is susceptible to curling so as to reduce curl of the sheet P. Accordingly, although sheet conveyors 100D and 100E described below with reference to FIGS. 12 and 15, respectively, are located downstream from the recording head unit 102 in the sheet conveyance direction C, the sheet conveyors 100D and 100E may be located at other positions.

Figure 12:
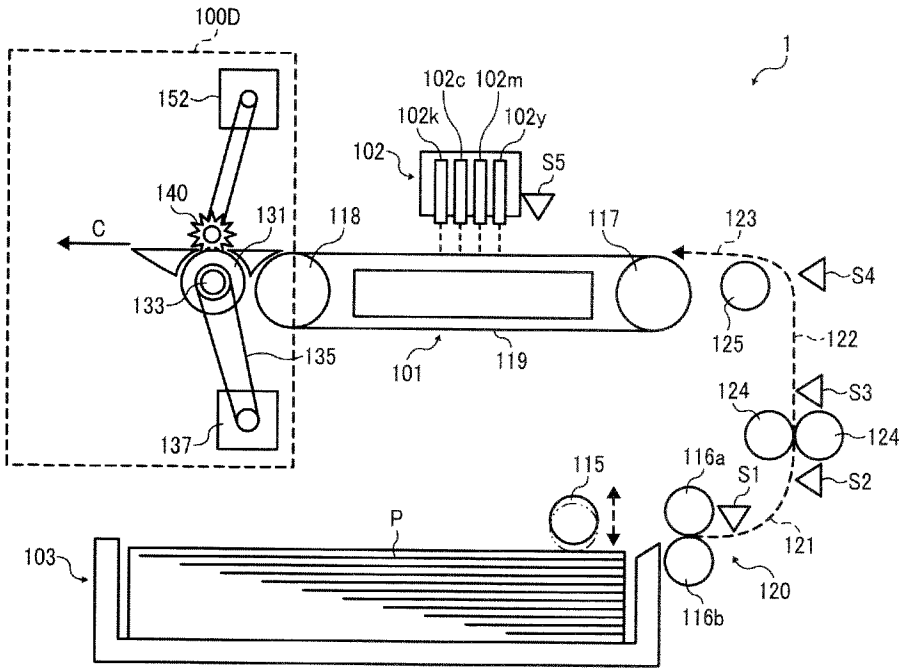
FIG. 12 is a schematic vertical sectional view of the image forming apparatus incorporating a sheet conveyor according to a fifth exemplary embodiment of this disclosure.
Figure 13:
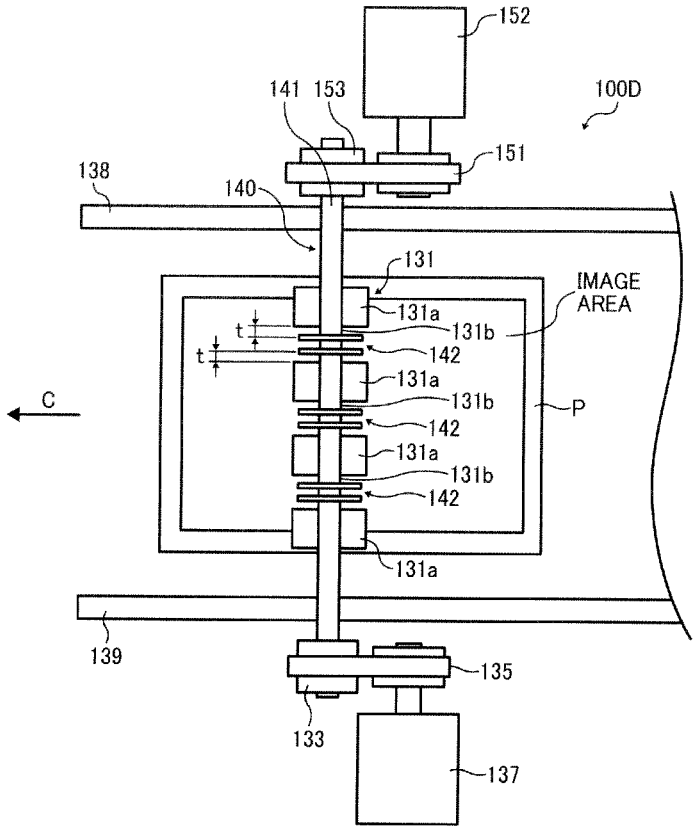
FIG. 13 is a plan view of the sheet conveyor shown in FIG. 12.

With reference to FIGS. 12 and 13, a description is provided of a construction of the sheet conveyor 100D according to a fifth exemplary embodiment.

FIG. 12 is a schematic vertical sectional view of the image forming apparatus 1 incorporating the sheet conveyor 100D. FIG. 13 is a plan view of the sheet conveyor 100D.

As shown in FIG. 12, the sheet conveyor 100D that conveys the sheet P to a sheet outlet of the image forming apparatus 1, instead of the curl correction device 100 depicted in FIG. 1, is located downstream from the recording head unit 102 in the sheet conveyance direction C. A configuration of the image forming apparatus 1 shown in FIG. 12 other than the sheet conveyor 100D is equivalent to that of the image forming apparatus 1 shown in FIG. 1.

As shown in FIG. 12, the sheet conveyor 100D includes the first roller 140 depicted in FIGS. 4 and 5 that comes into contact with the imaged side of the sheet P and the second roller 131 that comes into contact with the non-imaged side of the sheet P opposite the imaged side of the sheet P. As described above, the second roller 131 includes the plurality of increased diameter portions 131*a* and the plurality of decreased diameter portions 131*b* alternately arranged in the axial direction of the second roller 131 to contour the second roller 131 into an uneven roller as shown in FIG. 13.

The first roller 140 includes the shaft 141 and the plurality of spurs 142 mounted on the shaft 141 with an interval between the adjacent spurs 142 in the axial direction of the first roller 140. The first roller 140 serves as a driving roller that receives a driving force transmitted from the driving motor 152 through the belt 151 and the pulley 153. The outermost diameter of each spur 142 serving as the increased diameter portion of the first roller 140 is smaller than the outer diameter of the increased diameter portion 131*a* of the second roller 131. The spur 142 of the first roller 140 is interposed between the adjacent increased diameter portions 131*a* of the second roller 131 in the axial direction thereof and disposed opposite the decreased diameter portion 131*b* of the second roller 131 such that the outer edge of the spur 142 is isolated from the second roller 131. The second roller 131 is driven and rotated by a driving force transmitted from the driving motor 137 serving as a driver through the belt 135 and the pulley 133. Thus, the second roller 131 serves as a driving roller that conveys the sheet P.

A description is provided of an operation of the sheet conveyor 100D having the construction described above.

As shown in FIG. 12, a sheet P conveyed from the sheet tray unit 103 receives ink droplets ejected from the recording head unit 102 that form an image on the sheet P while the sheet P is adhered to and conveyed by the conveyance belt 119. Thereafter, the sheet P is conveyed to the sheet conveyor 100D where the sheet P enters a gap between the first roller 140 and the second roller 131. Unlike the first roller 130 depicted in FIG. 1 that is driven by the second roller 131 and the third roller 132 through the sheet P, the first roller 140 depicted in FIG. 13 includes the shaft 141 mounting the spurs 142 and being driven and rotated by the driving motor 152 serving as a first roller driver. The driving motor 137 serves as a second roller driver that drives and rotates the second roller 131. Accordingly, the first roller 140 reduces shock jitter that may arise when the sheet P enters the gap between the first roller 140 and the second roller 131. It is to be noted that the curl correction devices 100A and 100B depicted in FIGS. 5 and 9 according to the second and third exemplary embodiments, respectively, also reduce shock jitter.

In the downsized image forming apparatus 1 shown in FIG. 12, the sheet P enters the sheet conveyor 100D while a trailing edge of the sheet P is below the recording head unit 102 that ejects ink droplets onto the sheet P. Accordingly, when the sheet P enters the gap between the first roller 140 and the second roller 131, shock jitter may arise and adversely affect the image on the sheet P directly. To address this problem, it is requested for the sheet conveyor 100D situated downstream from the recording head unit 102 in the sheet conveyance direction C to reduce shock jitter.

If the interval t between the spur 142 of the first roller 140 and the increased diameter portion 131*a* of the second roller 131 shown in FIG. 13 is changed, the spur 142 that comes into contact with the imaged side of the sheet P may cause retransfer of ink on a margin of the sheet P outside an image area of the sheet P. FIG. 14A is a lookup table showing a relation between the interval t and retransfer of ink. As shown in FIG. 14A, when the interval t is 0.5 mm or 1 mm, the spur 142 causes retransfer of ink on the sheet P. Conversely, when the interval t is 3 mm, 5 mm, or 8 mm, the spur 142 does not cause retransfer of ink on the sheet P. FIG. 14B is a lookup table showing a relation between the interval t and a conveyance force of the first roller 140 and the second roller 131 to convey the sheet P when the spur 142 does not cause retransfer of ink. As shown in FIG. 14B, when the interval t is 3 mm, 5 mm, or 8 mm, the conveyance force of the first roller 140 and the second roller 131 is greater than 0.1 N and therefore sufficient. As shown in FIGS. 14A and 14B, when the interval t is greater than about 1 mm and smaller than about 8 mm, the spur 142 does not cause retransfer of ink and at the same time the first roller 140 and the second roller 131 attain a sufficient conveyance force to convey the sheet P.

In order to reduce retransfer of ink, it is preferable to increase the interval t. However, the increased interval t decreases an area of the second roller 131 where the second roller 131 supports the sheet P, bending the sheet P. Accordingly, a conveyance force of the spurs 142 of the first roller 140 and the second roller 131 to convey the sheet P is not transmitted to the sheet P. Hence, the interval t has the upper limit to secure the proper conveyance force to convey the sheet P. For example, according to the fifth exemplary embodiment shown in FIGS. 12 and 13, a lower limit of the interval t is about 1 mm; an upper limit of the interval t is about 8 mm.

With reference to FIGS. 15, 16A, 16B, and 17, a description is provided of a construction of the sheet conveyor 100E according to a sixth exemplary embodiment.

Figure 15:
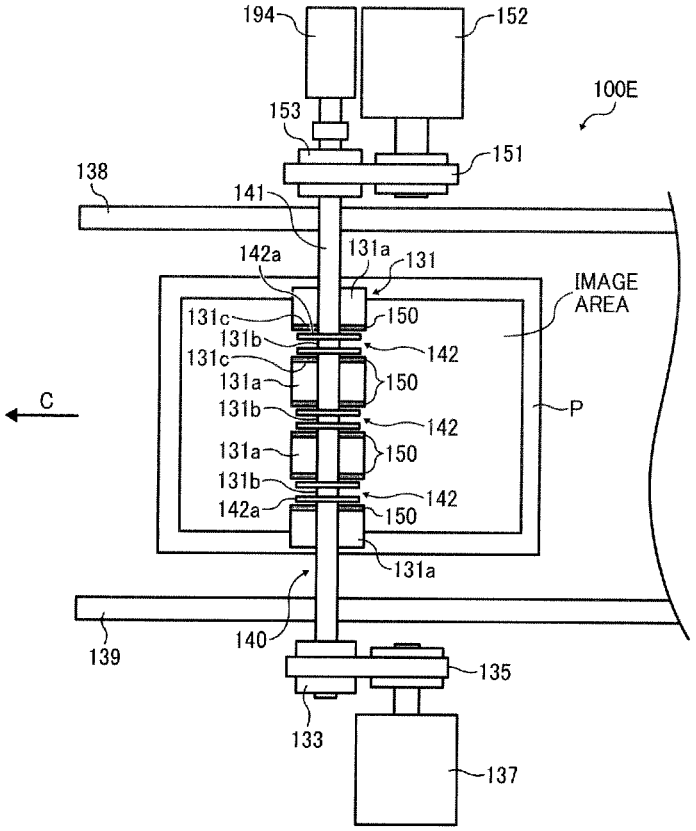
FIG. 15 is a plan view of a sheet conveyor according to a sixth exemplary embodiment of this disclosure.
Figure 16A:
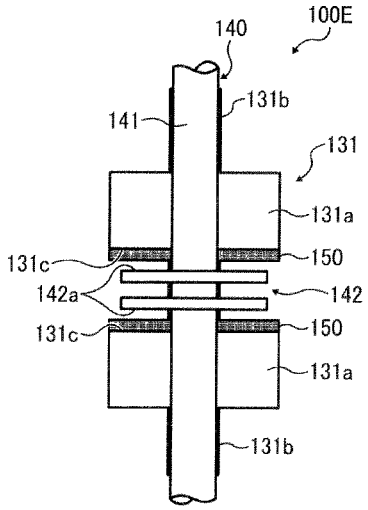
FIG. 16A is an enlarged partial plan view of the sheet conveyor shown in FIG. 15 when a first roller and a second roller incorporated therein convey a sheet.
Figure 16B:
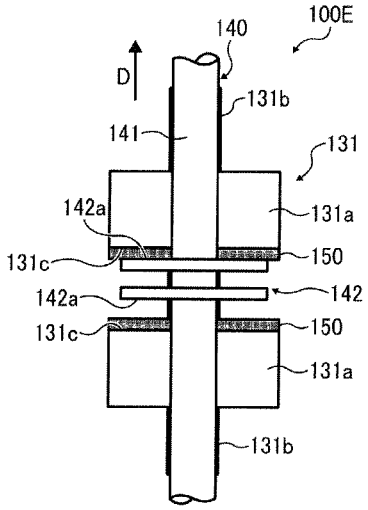
FIG. 16B is an enlarged partial plan view of the sheet conveyor shown in FIG. 15 when the first roller and the second roller do not convey the sheet.

FIG. 15 is a plan view of the sheet conveyor 100E according to the sixth exemplary embodiment of this disclosure. As shown in FIG. 15, the sheet conveyor 100E includes a cleaner 150 mounted on a side face 131*c* of the increased diameter portion 131*a* of the second roller 131 and disposed opposite a side face 142*a* of the spur 142 of the first roller 140. For example, the side face 131*c* of the increased diameter portion 131*a* of the second roller 131 is disposed opposite the side face 142*a* of the spur 142. The ring-shaped cleaner 150 is attached to the side face 131*c* of the increased diameter portion 131*a* of the second roller 131. An electromagnetic solenoid 194 serving as an actuator is connected to one axial end of the shaft 141 of the first roller 140 to move the first roller 140 in the axial direction thereof. When the driving motors 152 and 137 drive and rotate the first roller 140 and the second roller 131, respectively, to convey the sheet P, the electromagnetic solenoid 194 isolates the spur 142 from the cleaner 150 as shown in FIG. 16A. FIG. 16A is an enlarged partial plan view of the sheet conveyor 100E when the first roller 140 and the second roller 131 convey the sheet P. Conversely, when the driving motors 152 and 137 halt the first roller 140 and the second roller 131, respectively, in absence of the sheet P, the electromagnetic solenoid 194 moves the shaft 141 in a direction D to bring the spur 142 into contact with the cleaner 150 as shown in FIG. 16B. FIG. 16B is an enlarged partial plan view of the sheet conveyor 100E when the first roller 140 and the second roller 131 do not convey the sheet P.

Figure 17:
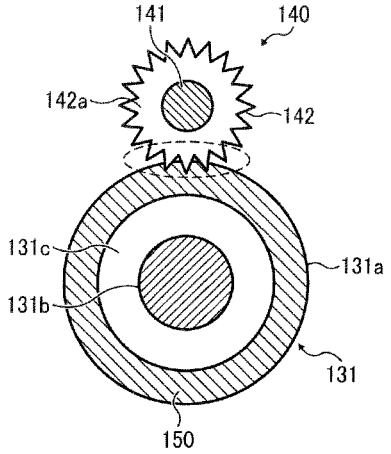
FIG. 17 is an enlarged vertical sectional view of the first roller, the second roller, and a cleaner incorporated in the sheet conveyor shown in FIG. 15.

FIG. 17 is an enlarged vertical sectional view of the first roller 140, the second roller 131, and the cleaner 150. The cleaner 150 mounted on the side face 131*c* of the increased diameter portion 131*a* of the second roller 131 is disposed opposite the side face 142*a* of the spur 142. Accordingly, the cleaner 150 in proximity to an outer circumferential surface of the increased diameter portion 131*a* of the second roller 131 rubs on a side face in proximity to an outer edge of the spur 142, removing ink from the outer edge of the spur 142.

As shown in FIG. 15, the electromagnetic solenoid 194 moves the shaft 141 mounting the spurs 142 in the axial direction of the first roller 140. When the first roller 140 and the second roller 131 rotate to convey the sheet P, the electromagnetic solenoid 194 isolates the spur 142 from the cleaner 150 as shown in FIG. 16A. Conversely, during maintenance of the sheet conveyor 100E, that is, when the first roller 140 and the second roller 131 halt, the electromagnetic solenoid 194 brings the spur 142 into contact with the cleaner 150, extending the life of the cleaner 150.

According to the sixth exemplary embodiment shown in FIG. 15, the cleaner 150 is mounted on the side face 131*c* of the increased diameter portion 131*a* of the second roller 131. Alternatively, the cleaner 150 may be mounted on other positions as long as the cleaner 150 is mounted on the shaft 141 at a position interposed between the increased diameter portion 131*a* and the spur 142.

According to the sixth exemplary embodiment shown in FIG. 15, the spur 142 mounted on the shaft 141 is movable with the shaft 141 to come into contact with and isolation from the cleaner 150. Alternatively, the cleaner 150 may be supported by a separate member separated from the shaft 141 at a position interposed between the increased diameter portion 131*a* and the spur 142. When the first roller 140 and the second roller 131 do not convey the sheet P, the separate member moves in an axial direction of the shaft 141 to bring the spur 142 into contact with the cleaner 150, cleaning the outer edge of the spur 142.

According to the sixth exemplary embodiment shown in FIG. 15, the spurs 142 are mounted on the shaft 141. Alternatively, spur pairs may be mounted on the shaft 141 instead of the spurs 142.

According to the fifth and sixth exemplary embodiments described above, the sheet conveyors 100D and 100E are situated downstream from the recording head unit 102 in the sheet conveyance direction C. Alternatively, the sheet conveyors 100D and 100E may be situated at other positions as long as the sheet conveyors 100D and 100E are on a sheet conveyance path through which the sheet P is conveyed.

A description is provided of advantages of the curl correction devices 100, 100A, 100B, and 100C described above.

The curl correction devices 100, 100A, 100B, and 100C include a plurality of rollers that reduces or eliminates curl of a sheet P serving as a recording medium while sandwiching and conveying the sheet P. The plurality of rollers includes a first roller (e.g., the first rollers 130, 140, and 180) that comes into contact with a first side, that is, the imaged side, of the sheet P that bears an image and a second roller (e.g., the second roller 131) and a third roller (e.g., the third roller 132) disposed opposite the first roller and aligned in the sheet conveyance direction C. The second roller and the third roller come into contact with a second side, that is, the non-imaged side, of the sheet P opposite the first side of the sheet P. Each of the first roller, the second roller, and the third roller includes a plurality of increased diameter portions (e.g., the increased diameter portions 130*a*, 131*a*, and 132*a* and the spurs 142 and 182) and a plurality of decreased diameter portions (e.g., the decreased diameter portions 130*b*, 131*b*, and 132*b*) that are alternately arranged in the axial direction of the first roller, the second roller, and the third roller to produce an uneven outer circumferential surface thereof. The first roller is interposed between the second roller and the third roller in the sheet conveyance direction C. When seen in a direction perpendicular to the axial direction of the first roller, the second roller, and the third roller, the increased diameter portions of the second roller is isolated from the increased diameter portions of the third roller, respectively. The increased diameter portions of the first roller overlap the increased diameter portions of the second roller and the third roller in the sheet conveyance direction C and a direction perpendicular to the sheet conveyance direction C. The increased diameter portions of the first roller are disposed opposite the decreased diameter portions of each of the second roller and the third roller, respectively, with a clearance therebetween. The decreased diameter portions of the first roller are disposed opposite the increased diameter portions of each of the second roller and the third roller, respectively, with a clearance therebetween.

The first roller that comes into contact with the first side of the sheet P is isolated from the second roller and the third roller that come into contact with the second side of the sheet P. Accordingly, even if ink is transferred from the first side of the sheet P to the first roller, ink is not retransferred from the first roller onto the sheet P, the second roller, and the third roller, rendering a cleaner for cleaning the second roller and the third roller unnecessary. Consequently, the curl correction devices 100, 100A, 100B, and 100C reduce curl of the sheet P and prevent resultant transfer of ink from the sheet P onto the first roller and retransfer of ink from the first roller onto the sheet P, the second roller, and the third roller that may stain the sheet P at reduced manufacturing costs without upsizing and complicating the curl correction devices 100, 1000A, 100B, and 100C.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a first roller to come into contact with a first side of a recording medium that bears an image to convey the recording medium;

a second roller disposed opposite the first roller; and a third roller disposed opposite the first roller and aligned with the second roller in a recording medium conveyance direction, the second roller and the third roller to come into contact with a second side of the recording medium opposite the first side thereof to convey the recording medium, each of the first roller, the second roller, and the third roller including:

a plurality of increased diameter portions, each having an increased diameter; and a plurality of decreased diameter portions, each having a decreased diameter, each of the plurality of increased diameter portions and each of the plurality of decreased diameter portions alternately arranged in an axial direction of each of the first roller, the second roller, and the third roller to produce an uneven outer circumferential surface thereof, wherein the plurality of increased diameter portions of the second roller is isolated from the plurality of increased diameter portions of the third roller, and wherein the plurality of increased diameter portions of the first roller is disposed opposite the plurality of decreased diameter portions of each of the second roller and the third roller, respectively, with a clearance therebetween and the plurality of decreased diameter portions of the first roller is disposed opposite the plurality of increased diameter portions of each of the second roller and the third roller, respectively, with a clearance therebetween such that the plurality of increased diameter portions of the first roller overlaps the plurality of increased diameter portions of each of the second roller and the third roller, respectively, in the recording medium conveyance direction and a direction perpendicular to the recording medium conveyance direction.

2. The image forming apparatus according to claim 1, wherein the plurality of increased diameter portions of the first roller is spaced apart from the plurality of increased diameter portions of at least one of the second roller and the third roller, respectively, in the axial direction thereof with an interval greater than about 0 mm and smaller than about 3 mm.

3. The image forming apparatus according to claim 1, wherein the plurality of decreased diameter portions of the first roller includes a shaft and the plurality of increased diameter portions of the first roller includes a plurality of spurs mounted on the shaft with an interval between adjacent spurs of the plurality of spurs in the axial direction of the first roller.

4. The image forming apparatus according to claim 1, wherein the plurality of decreased diameter portions of each of the first roller, the second roller, and the third roller includes a shaft and the plurality of increased diameter portions of each of the first roller, the second roller, and the third roller includes a plurality of rollers mounted on the shaft with an interval between adjacent rollers of the plurality of rollers in the axial direction of each of the first roller, the second roller, and the third roller.

5. The image forming apparatus according to claim 4, wherein the plurality of rollers of each of the second roller and the third roller is isolated from the plurality of rollers of the first roller.

6. The image forming apparatus according to claim 1, wherein the second roller is disposed upstream from the third roller in the recording medium conveyance direction, and wherein an increased interval is provided between adjacent increased diameter portions of the plurality of increased diameter portions of the third roller in the axial direction thereof, the increased interval being greater than a decreased interval provided between adjacent increased diameter portions of the plurality of increased diameter portions of the second roller in the axial direction thereof.

7. The image forming apparatus according to claim 1, further comprising:

a driver connected to the first roller to move the first roller in a direction perpendicular to the first side of the recording medium; and a controller operatively connected to the driver to drive the driver to move the first roller according to at least one of an environmental condition and a type of the recording medium.

8. The image forming apparatus according to claim 1, wherein an outer diameter of each of the plurality of increased diameter portions of the first roller is smaller than an outer diameter of each of the plurality of increased diameter portions of the second roller and the third roller.

9. The image forming apparatus according to claim 1, further comprising an image recording device to form an image on the recording medium with one of ink and toner.

* * * * *